US005462447A

United States Patent [19]

Boiret et al.

[11] Patent Number: 5,462,447

[45] Date of Patent: Oct. 31, 1995

[54] ELECTRICAL CONNECTOR HAVING AN INSERTION AND EXTRACTION BRACKET

[75] Inventors: Gérard Boiret, Yvre L'Eveque; Thierry Quillet, Saint Pavace, both of France

[73] Assignee: Framatome Connectors International, Courbevoie, France

[21] Appl. No.: 240,436

[22] Filed: May 10, 1994

[30] Foreign Application Priority Data

May 10, 1993 [FR] France ..... 93 05579

[51] Int. Cl.[6] ..... H01R 4/50

[52] U.S. Cl. ..... 439/347; 439/157

[58] Field of Search ..... 439/347, 352, 439/152–160, 372, 345

[56] References Cited

U.S. PATENT DOCUMENTS 5,169,327 12/1992 Hatagishi ..... 439/157
5,183,408 2/1993 Hatagishi ..... 439/147

FOREIGN PATENT DOCUMENTS 2424643 11/1979 France .

*Primary Examiner*—David L. Pirlot
*Attorney, Agent, or Firm*—Pollock, Vande Sande & Priddy

[57] ABSTRACT

An electrical connector has a base having two mutually parallel side walls and a plug displaceable parallel to the side walls of the base in an insertion and extraction direction and having outwardly projecting studs, orthogonal to the direction of insertion and located in a zone which remains outside the base in a fully-inserted position. It further comprises a bracket for forcibly inserting and extracting the plug into and out of the base, having branches slidable along the side walls orthogonal to the insertion and extraction direction. The branches are formed with stud receiving passages of such a shape that displacement of the bracket causes the studs to move farther into and along said passages from open ends thereof, or expels the studs from the passages, depending on the direction of displacement. The plug further has resilient latching tabs located to engage behind the bracket when the plug is fully inserted, thereby resiliently retaining the plug.

5 Claims, 1 Drawing Sheet

F

ELECTRICAL CONNECTOR HAVING AN INSERTION AND EXTRACTION BRACKET

BACKGROUND OF THE INVENTION

The present invention relates to a rectangular electrical connector of the type comprising:

- a base adapted to contain first electrical contacts and having two parallel side walls;
- a plug adapted to contain second contacts suitable for mating with the first contacts, the plug being displaceable parallel to the side walls of the base in an insertion and extraction direction, the plug having outwardly projecting studs, directed orthogonally to said direction, and located in a zone which remains outside the base in a fully-inserted position of the latter, and
- a bracket for inserting and extracting the plug, capable of sliding along the side walls in a direction orthogonal to the insertion direction, having open-ended stud-receiving passages formed therein and of a shape such that displacement of the bracket in a first direction transverse to the insertion direction causes the studs to penetrate further into the passages from the open ends thereof, and such that displacement in the opposite direction expels the studs from the passages.

Numerous connectors of that type are already known and they are often referred to as assisted insertion and extraction connectors. An example is given in FR-A-2 424 643.

Most known connectors of the above-defined type do not provide complete security when they are located in vibrating surroundings. Vibrations can exert forces on the plug tending to disengage it from the base. The focus, as they are transmitted by the studs, cause the plugs to slide along and out of the passages.

SUMMARY OF THE INVENTION

An object of the present invention is to provide an electrical connector having a bracket that satisfies practical requirements better than those known in the past, particularly in that it substantially reduces the above risk.

To this end, there is provided a connector in which the plug includes resilient latching tabs located in such a manner as to engage behind the bracket at the end of insertion, thereby retaining the plug.

If such a connector is subjected to vibrations, then any forces that may appear in the uncoupling direction are taken up by the engagement of the tabs and are not transmitted through the contact between the studs and the passages.

In the common case where the plug is a molded part of plastic material that is reinforced with a filler, the latching tabs are advantageously constituted by two fork-shaped end portions of the plug, which are incompletely separated from the middle portion of the plug by slots.

In order to enable easy engagement of the tabs during insertion, notches are advantageously provided in that end portion of the bracket which comes closer to the base during insertion, for receiving end catches of the tabs. Once the catches have gone through the openings, subsequent sliding of the bracket brings them behind the latching zones.

Advantageously, the passages that constitute insertion and extraction cams each have an end portion that is substantially parallel to the displacement direction of the bracket, i.e., perpendicular to the insertion direction, end portion being of such dimensions that the studs penetrate therein as soon as the catches of the tabs have passed through the notches.

The invention will be better understood from the following description of a particular embodiment, given by way of example.

BRIEF DESCRIPTION OF THE DRAWINGS

The description refers to the accompanying drawings, wherein.

DETAILED DESCRIPTION

Figures 1, 2, 3, 4, 5:
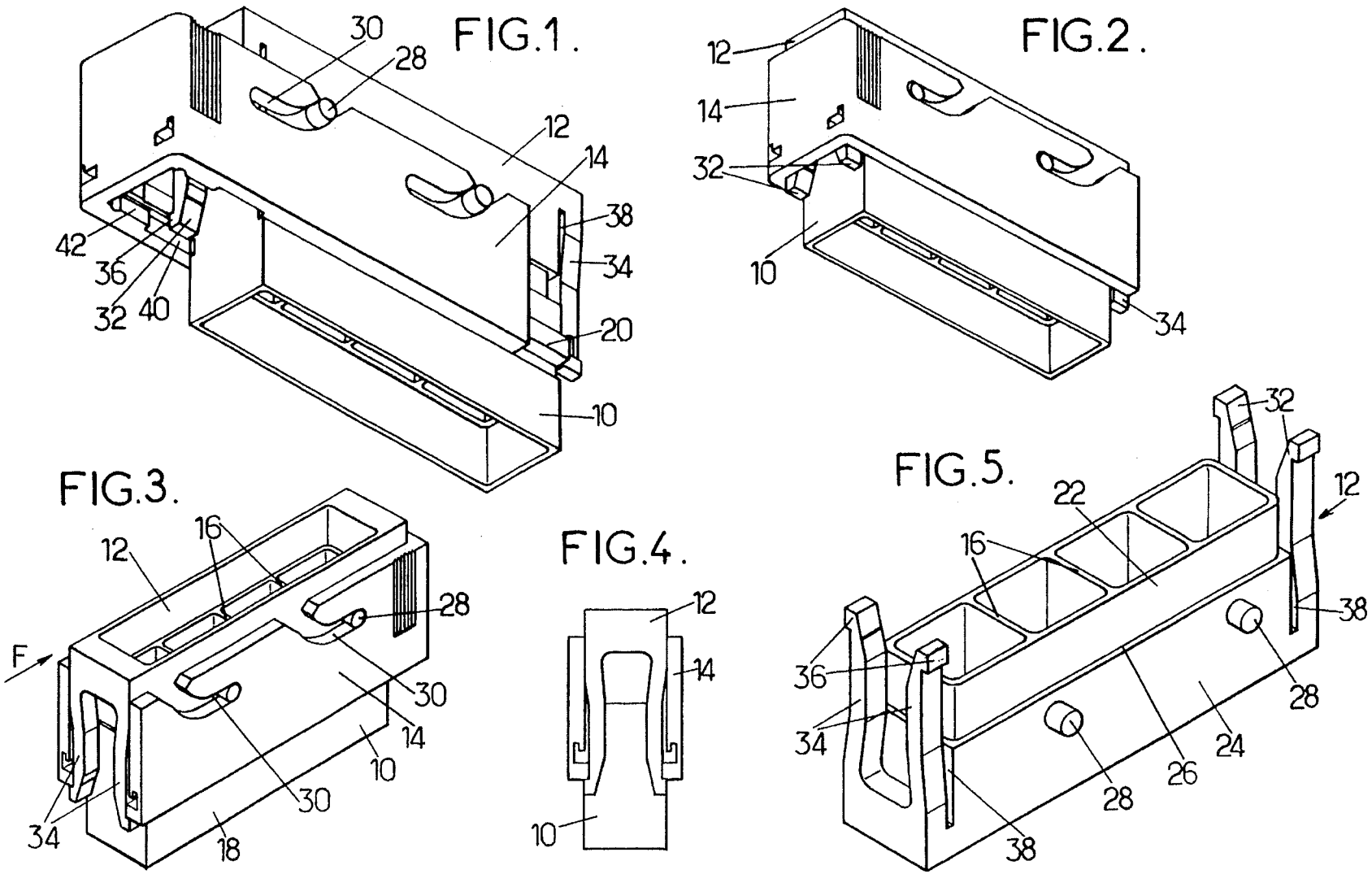
FIG. 1 is a perspective view of the connector as seen from the base side thereof, with the bracket in the position in which the studs are located at the entrances of the passages.
FIG. 2 is similar to FIG. 1 and shows the bracket when fully pushed home.
FIG. 3 is a perspective view of the connector with the bracket fully pushed home, as seen from the plug side.
FIG. 4 is an end view of the connector, in the direction of arrow F in FIG. 3.
FIG. 5 is a detail view on a larger scale, showing the plug in upside down position, relative to the position shown in FIGS. 1 to 4.

As shown, the connector comprises two housings, which will be considered as constituting a base 10 and a plug 12. The terms "plug" and "base" are used for the sake convenience and do not imply in any way that the base constitutes a fixed element. The base carries an insertion and extraction bracket 14.

The plug and the base that are shown are of a type that is referred to as being "modular", comprising compartments that are separated by partitions such as 16, and are designed to receive wafers each containing contacts (not shown). Such modular structure is not part of the invention and is not essential.

The base 10 is of elongate rectangular cross-section and in its longer direction it has two parallel side walls 18 provided with slidable keying means enabling the bracket 14 to move in direction F (FIG. 3) while being prevented from moving in the insertion and extraction direction, which is orthogonal to F.

In the embodiment shown in FIG. 1, two splines 20 integral with the base project into grooves, not shown, formed in the inside surface of the bracket and extending from an open end of the bracket to a place close to the bottom end thereof, belonging to the keying means.

The plug 12 is also of rectangular cross-section. A major position of its outside surface is smooth. As shown in FIG. 5, its has a front portion 22 slidably engageable in the base, and a back or rear portion 24 that is separated from the front portion by a shoulder 26. The shoulder is in the immediate proximity of or in abutment against the base when the connector is in coupled condition.

The bracket 14 and the plug 12 comprise means that cooperate, in response to displacements of the bracket 14, to cause the plug to be inserted or extracted depending on the direction of displacement.

The means carried by the plug comprise at least one pair of studs 28 that project from the back portion 24, on both sides of the plug. In the embodiment shown, two pairs of studs 28 are provided, thereby providing better guidance of the plug while it is being inserted and/or extracted.

The studs 28 are shaped to project into passages 30 cut out in the bracket 14 and opening into an edge of the bracket that faces the plug. The mouth portions of the passages are flared so as to facilitate entry of the studs 28, and the passages are curved. Initially, the passages are at an angle relative to the displacement direction of the bracket. In their end portion, they are parallel to the displacement direction, so that applying a tractive force to the plug does not tend to expel the bracket.

According to an aspect of the invention, means are provided for positively retaining the plug once it has been fully inserted by displacing the bracket in the insertion direction.

As shown in the drawings, these means comprise two pairs of resilient tabs 32 and 34 belonging to the plug. Each tab has a terminal latching catch 36 which engages under a latching zone of the bracket when the bracket reaches the end of its travel.

When the components of the connector are made of molded plastic material, as is usually the case, then each pair of tabs may be constituted as a fork-shaped end portion of the plug, which is incompletely separated from the middle portion of the plug by slots 38 (FIG. 5) extending parallel to the insertion direction of the plug. If a sufficient amount of slope is provided, such a plug can be made without any special difficulty.

The catches of the tabs 32 engage nicely behind the end latching zones of the bracket 14 when the bracket reaches the end of its insertion stroke.

To facilitate movement of the catches 36 of the tabs 32, notches 40 are advantageously provided on the inner surfaces of the branches of the bracket. The notches are long enough to remain in registry with the tabs 32 until the catches have gone past the bracket during insertion of the plug. Once the catches have moved beyond the bracket, additional displacement of the bracket brings latching zones 42 behind the catches.

The operation of the connector is conventional. For coupling, the bracket is first moved back to a position that can be defined by a resilient latch and in which the studs 28 are in the mouths of the passages 30. The plug 12 is then placed on the base 10 and takes up the position shown in FIG. 1. The bracket 14 is then pushed in. At the beginning of this movement, the sloped portion of one edge of each of the passages 30 acts as a cam to urge the respective stud in the insertion direction. Once full insertion has been achieved, further displacement of the bracket brings the studs up to the ends of the portions of the passages which are parallel to the bracket displacement direction, and simultaneoulsy brings the latching zones behind the catches of the tabs.

To uncouple the connector, it suffices to draw out the bracket and the above-described sequence is reversed, except that the edge of each passage that now acts as a cam is the edge that was not used for that purpose during insertion.

We claim:

1. An electrical connector comprising:

(a) a base member adapted to contain first electrical contacts and having two mutually parallel side walls;

(b) a plug member adapted to contain second contacts suitable for mating with said first contacts, said plug member being displaceable parallel to side walls of said base member in an insertion and extraction direction and having outwardly projecting studs orthogonal to said direction and located in a zone which remains outside said base member in a fully-inserted position of said plug member in said base member; and (c) a bracket for forcibly inserting and extracting said plug member into and out of said base member, said bracket having branches sized to be capable of sliding along said side walls along a first direction orthogonal to said insertion and extraction direction and along a second direction opposite to said first direction, said branches being formed with stud receiving passages of a shape such that displacement of said bracket in said first direction causes said studs to move farther into and along said passages from open ends thereof, and that displacement in said second direction expels said studs from said passages;

(d) said plug further including resilient latching tabs so located as to engage behind said bracket when the plug member is fully inserted, thereby resiliently retaining said plug member, said latching tabs comprising two end portions of said plug member, defining a fork which is incompletely separated from a middle portion of said plug member by slots cut parallel to said direction of insertion and extraction.

2. An electrical connector according to claim 1, wherein notches are formed in that end portion of the bracket which comes closer to the base during insertion, for slidably receiving end catches of said tabs.

3. An electrical connector according to claim 2, wherein said catches are shaped to be located under said bracket in a fully inserted position of said plug.

4. An electrical connector according to claim 2, wherein said openings constitute insertion and extraction cam ramps and each have an end portion that is substantially parallel to said first direction.

5. An electrical connector according to claim 4, wherein each said end portion has a size such that the respective stud enters it as soon as the catches of the tabs have passed beyond the notches.

* * * * *